US006866074B1

(12) United States Patent
Egge et al.

(10) Patent No.: US 6,866,074 B1
(45) Date of Patent: Mar. 15, 2005

(54) SAND TANK

(76) Inventors: Alan R. Egge, 700 W. 21st St., Yankton, SD (US) 57078; Jeffery A. Wendte, 700 W. 21st St., Yankton, SD (US) 57078

( * ) Notice: Subject to any disclaimer, the term of this patent is extended or adjusted under 35 U.S.C. 154(b) by 0 days.

(21) Appl. No.: 10/778,834

(22) Filed: Feb. 12, 2004

(51) Int. Cl.[7] ..... B65B 1/04

(52) U.S. Cl. ..... 141/98; 141/95; 222/64; 209/13

(58) Field of Search ..... 141/98, 95, 198; 222/64; 209/44, 13, 12.1, 17, 18

(56) References Cited

U.S. PATENT DOCUMENTS 3,114,479 A * 12/1963 Keeney ..... 222/64
4,199,080 A * 4/1980 Keeney ..... 222/23
6,561,359 B2 * 5/2003 Egge et al. ..... 209/44

* cited by examiner

*Primary Examiner*—Steven O. Douglas
(74) *Attorney, Agent, or Firm*—Chambliss, Bahner & Stophel, P.C.

(57) ABSTRACT

A tank assembly for classifying and blending sand products. The tank assembly includes a receptacle adapted to retain slurry at or below an upper level. The receptacle includes a feed end having a receptacle inlet, a discharge end having a receptacle overflow outlet, and a pair of side walls extending between the feed end and the discharge end. The discharge end of the receptacle is generally opposed to the feed end. The tank assembly also includes a plurality of upper cross tubes mounted to and extending between the pair of side walls of the receptacle. Each of the plurality of upper cross tubes is disposed above the upper level of the receptacle. The tank assembly further includes a plurality of settling stations mounted in the receptacle. Each of the settling stations includes an adjustable height sensing paddle adapted to control the amount of slurry that accumulates at the station, a discharge valve, and a slurry discharge pipe. Still further, the tank assembly includes a slurry collecting flume extending to and in communication with the slurry discharge pipes. The slurry collecting flume includes a slurry collecting flume outlet.

14 Claims, 9 Drawing Sheets

SAND TANK

FIELD OF THE INVENTION

The present invention relates generally to sand tanks, and particularly to sand tank assemblies for classifying and blending sand products.

BACKGROUND AND DESCRIPTION OF THE PRIOR ART

It is known to classify and blend sand products using sand tank assemblies. It is also known to remove excess water, clay, silt, slimes and the like from a mixture of liquids and insoluble substances such as slurry using sand tank assemblies. More particularly, conventional sand tank assemblies include an elongated receptacle having a feed end and a discharge end opposite the feed end. Typically, a combination of sand and water (or some other slurry) is introduced into the feed end of the receptacle which is partially filled with water. As the slurry flows toward the discharge end, it is naturally classified as the heavier and coarser sand falls closer to the feed end of the receptacle and the lighter and finer sand flows toward and falls closer to the discharge end of the receptacle. Settling stations are typically positioned along the length of the receptacle. Each conventional settling station includes a valve for discharging sand from the receptacle into a slurry collecting flume for selective blending of the sand.

In addition, conventional sand tank assemblies include an overflow collecting flume for removing excess water, clay, silt, slimes and the like from the receptacle. More particularly, clays, silt and slimes which are lighter than the finest sand remain suspended in the water contained in the conventional receptacle. The suspended clays, silt and slimes are washed out of the conventional receptacle by the overflow collecting flume. The overflow collecting flume is typically in communication with a receptacle overflow outlet adapted to convey excess water, clay, silt, slimes and the like from the receptacle.

However, conventional sand tank assemblies suffer from several disadvantages. For example, conventional sand tank assemblies produce turbulence and interfere with the natural flow and settling of slurry in the receptacle. More particularly, conventional sand tank assemblies include structural cross-members mounted between the opposing side walls of the receptacle, and those structural cross-members are positioned such that they are submerged within or otherwise make contact with the slurry in the receptacle. Further, conventional sand tank assemblies have a generally square feed box for introducing slurry into the feed end of the receptacle which results in inconsistent settling of the slurry. In addition, conventional sand tank assemblies include complex and expensive structural support systems that do not efficiently resist the bulging forces produced by the water and slurry retained in the receptacle. For example, conventional sand tank assemblies include receptacles having an expensive and complex arrangement of flat support bars mounted to the side walls of the receptacle. Further, the overflow collecting flume on conventional sand tank assemblies extends along only a portion of the length of the receptacle. As a result, removal of excess water, clay, silt, slimes and the like is inefficient, and the structural stability of the receptacle is compromised.

It would be desirable, therefore, if an apparatus could be provided that would reduce turbulence and interference with the natural flow of slurry in the receptacle of a sand classifying and blending tank. It would be further desirable if an apparatus could be provided that would more effectively introduce slurry into the receptacle of a sand classifying and blending tank. It would also be desirable if an apparatus could be provided that would reduce the cost, simplify the construction, and improve the strength and structural stability of the receptacle of a sand classifying and blending tank. It would be still further desirable if an apparatus could be provided that would more effectively remove excess water, clay, silt, slimes and the like from the receptacle of a sand classifying and blending tank.

ADVANTAGES OF THE INVENTION

Accordingly, it is an advantage of the invention claimed herein to provide an apparatus that reduces turbulence and interference with the natural flow and settling of slurry in the receptacle of a sand classifying and blending tank. It is a further advantage of the invention to provide an apparatus that more effectively introduces slurry into the receptacle of a sand classifying and blending tank. It is also an advantage of the invention to provide an apparatus that reduces the cost, simplifies the construction, and improves the strength and structural stability of the receptacle of a sand classifying and blending tank. It is a still further advantage of the invention to provide an apparatus that more effectively removes excess water, clay, silt, slimes and the like from the receptacle of a sand classifying and blending tank.

Additional advantages of the invention will become apparent from an examination of the drawings and the ensuing description.

Explanation of Technical Terms

As used herein, the term "receptacle" refers to any generally hollow structure used for holding slurry. The term "receptacle" includes both open and closed containers, tanks, vessels, basins and the like.

As used herein, the term "sand products" refers to any combination or mixture of particulate, granular or aggregate materials.

As used herein, the term "slurry" refers to any mixture or combination of liquid(s) and insoluble substance(s) that is capable of flowing viscously. The term "slurry" includes, but is not limited to, any type of liquid such as water and any type of solid particulate material such as sand, cement, clay, coal, crushed stone, gravel and the like.

SUMMARY OF THE INVENTION

The invention comprises a tank assembly for classifying and blending sand products. The tank assembly includes a receptacle adapted to retain slurry at or below an upper level. The receptacle includes a feed end having a receptacle inlet, a discharge end having a receptacle overflow outlet, and a pair of side walls extending between the feed end and the discharge end. The discharge end of the receptacle is generally opposed to the feed end. The tank assembly also includes a plurality of upper cross tubes mounted to and extending between the pair of side walls of the receptacle. Each of the plurality of upper cross tubes is disposed above the upper level of the receptacle. The tank assembly further includes a plurality of settling stations mounted in the receptacle. Each of the settling stations includes an adjustable height sensing paddle adapted to control the amount of slurry that accumulates at the station, a discharge valve, and a slurry discharge pipe. Still further, the tank assembly includes a slurry collecting flume extending to and in communication with the slurry discharge pipes. The slurry collecting flume includes a slurry collecting flume outlet.

In a preferred embodiment, the tank assembly includes a feed box having a curved liner, a feed end reinforcing plate mounted near the top of the receptacle, a pair of overflow collecting flumes extending from the feed end to the discharge end, a plurality of lateral support tubes mounted to the exterior of the pair of side walls of the receptacle, and a plurality of vertical reinforcing plates mounted to the pair of side walls of the receptacle.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
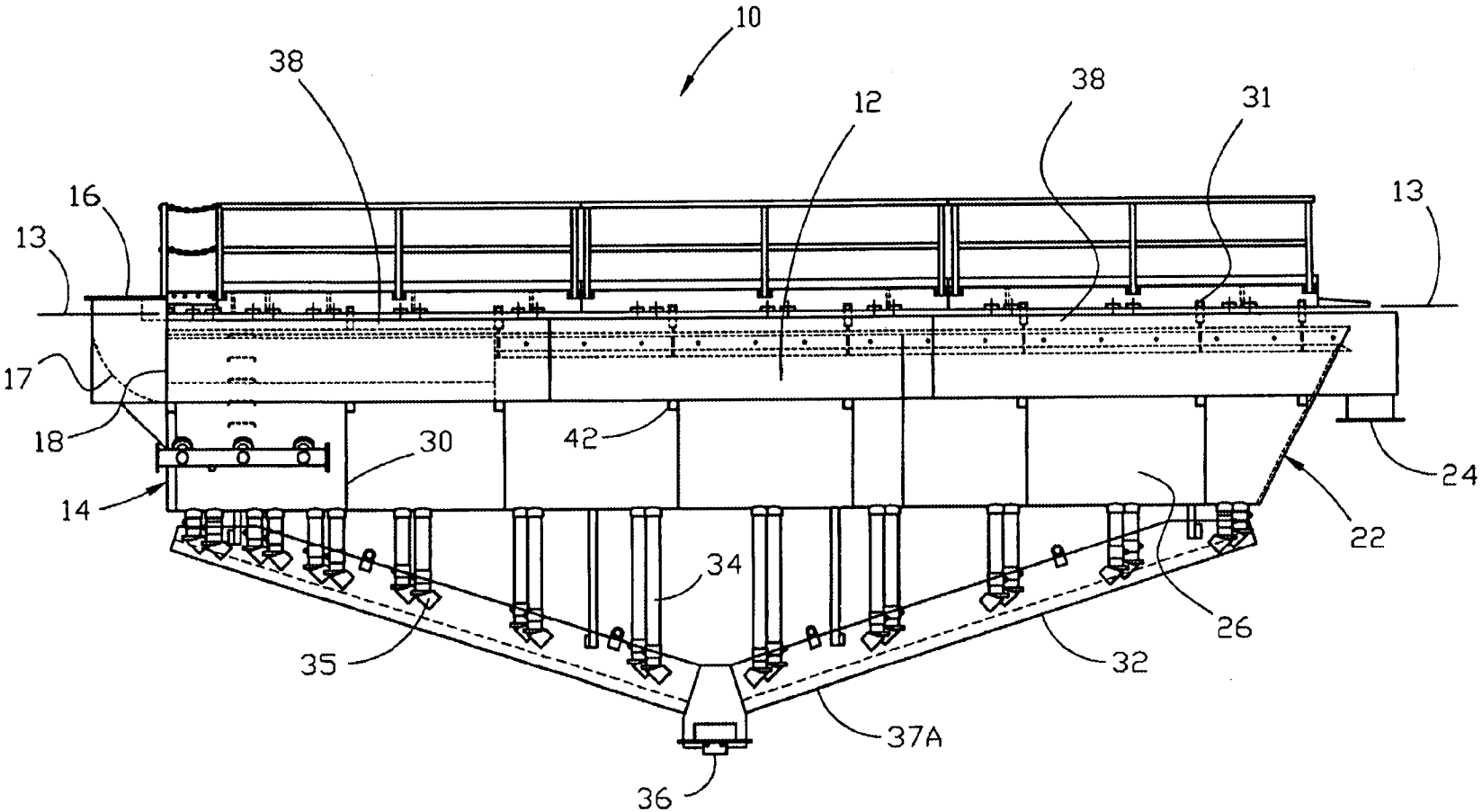
FIG. 1 is a front view of a preferred embodiment of the sand tank assembly in accordance with the present invention.

Referring now to the drawings, the preferred embodiments of the tank assembly for classifying and blending sand products are illustrated by FIGS. 1 through 9. More particularly, FIG. 1 is a front view of the preferred embodiment of the tank assembly for classifying and blending sand products. As shown in FIG. 1, the preferred tank assembly is designated generally by reference numeral 10. The preferred tank assembly 10 includes receptacle 12 which is adapted to retain slurry at or below upper level 13 of the receptacle. It is contemplated within the scope of the invention that the receptacle is adapted to retain any mixture or combination of liquid(s) and insoluble substance(s) that flows viscously such as water and pulverized solid or fine particulate material such as sand. Further, while receptacle 12 is illustrated as a generally rectangular container (See also FIG. 2), it is contemplated within the scope of the invention that the receptacle may be any generally hollow container, tank, vessel, basin or the like used for holding slurry, and the receptacle may be open at the top or closed.

As shown in FIG. 1, the preferred receptacle 12 also includes feed end 14 which is adapted to receive slurry. In a preferred embodiment, feed box 16 is attached to feed end 14. Also in a preferred embodiment, feed box 16 has curved liner 17 which is adapted to improve the flow of slurry into receptacle 12. Slurry enters into receptacle 12 through receptacle inlet 18. Discharge end 22 is generally opposite feed end 14. Discharge end 22 includes receptacle overflow outlet 24 which is adapted to convey excess water, clay, silt, slimes and the like from the receptacle.

Figure 2:
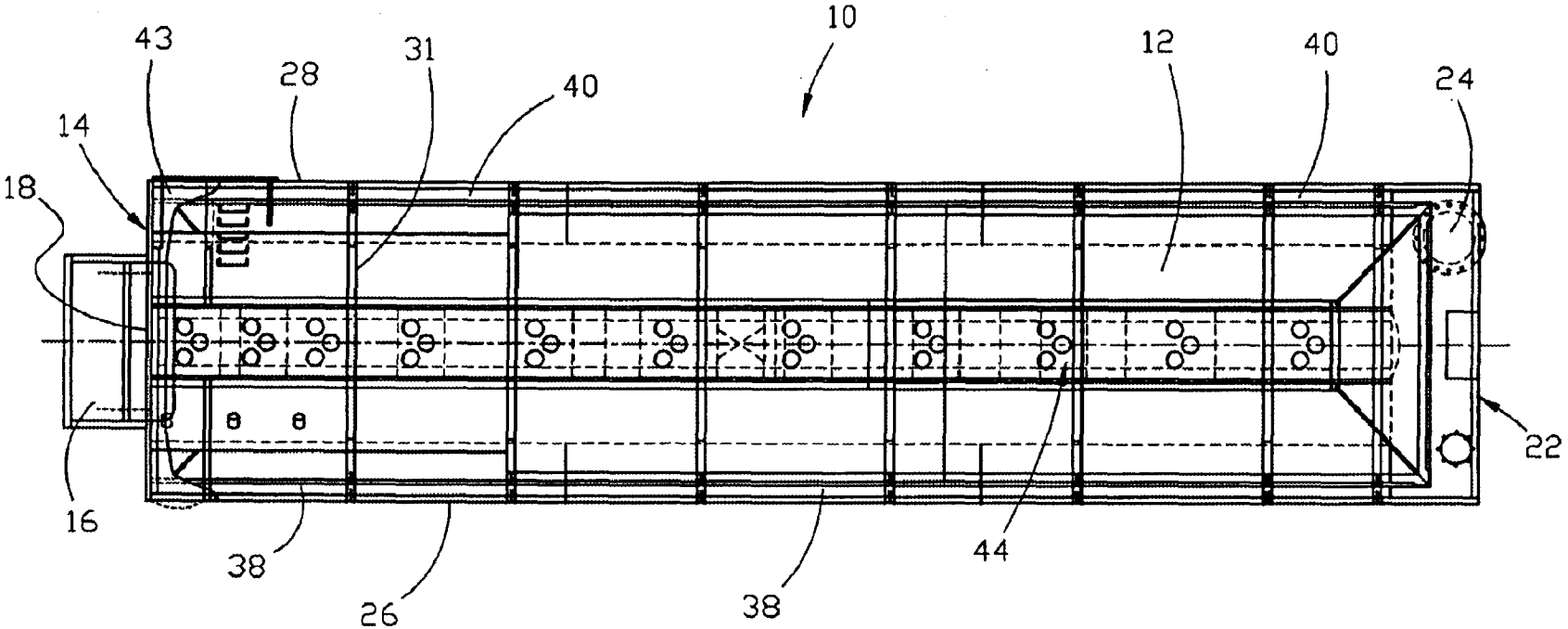
FIG. 2 is a top view of the preferred embodiment of the sand tank assembly illustrated by FIG. 1.
Figure 3:
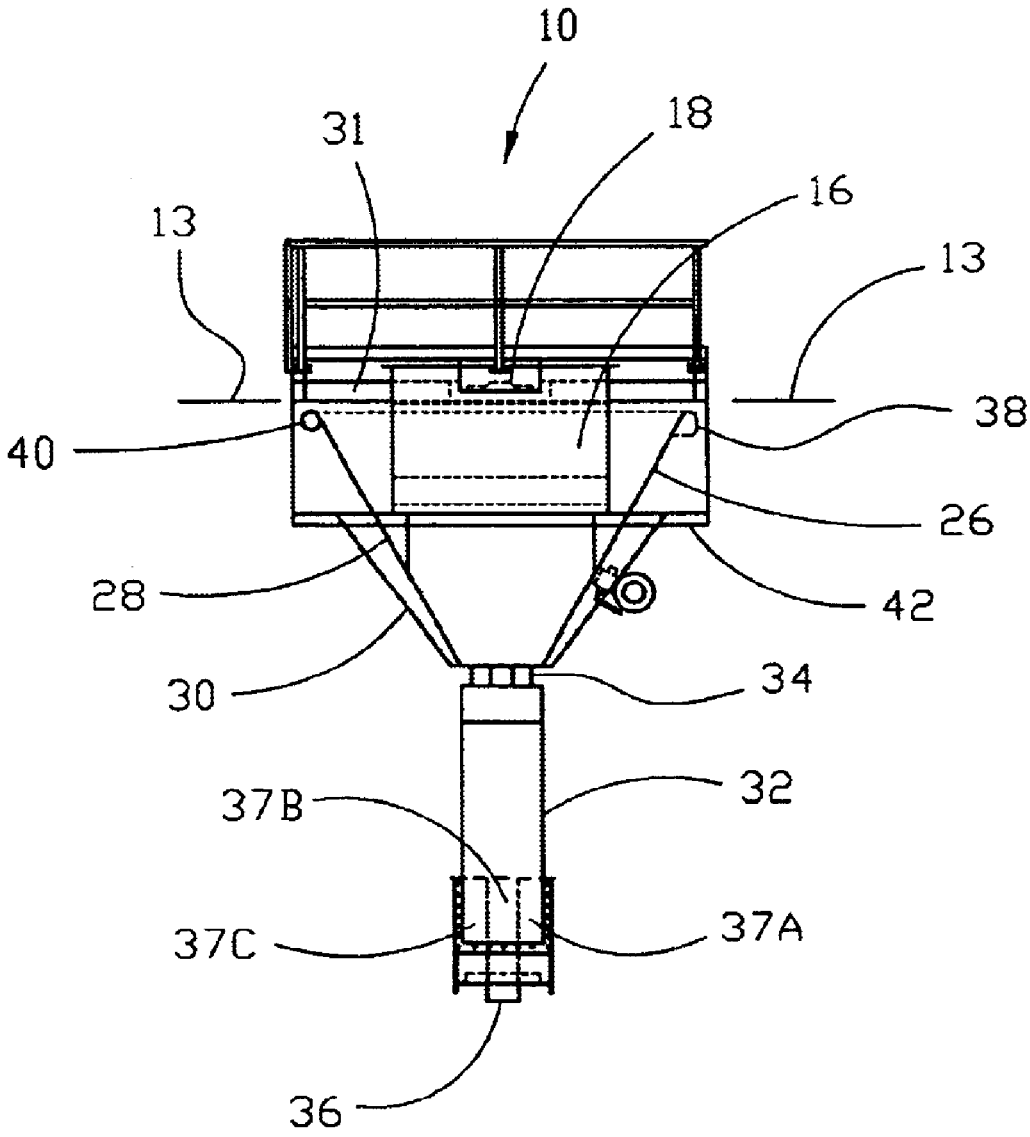
FIG. 3 is a left side view of the preferred embodiment of the sand tank assembly illustrated by FIGS. 1 and 2.
Figure 4:
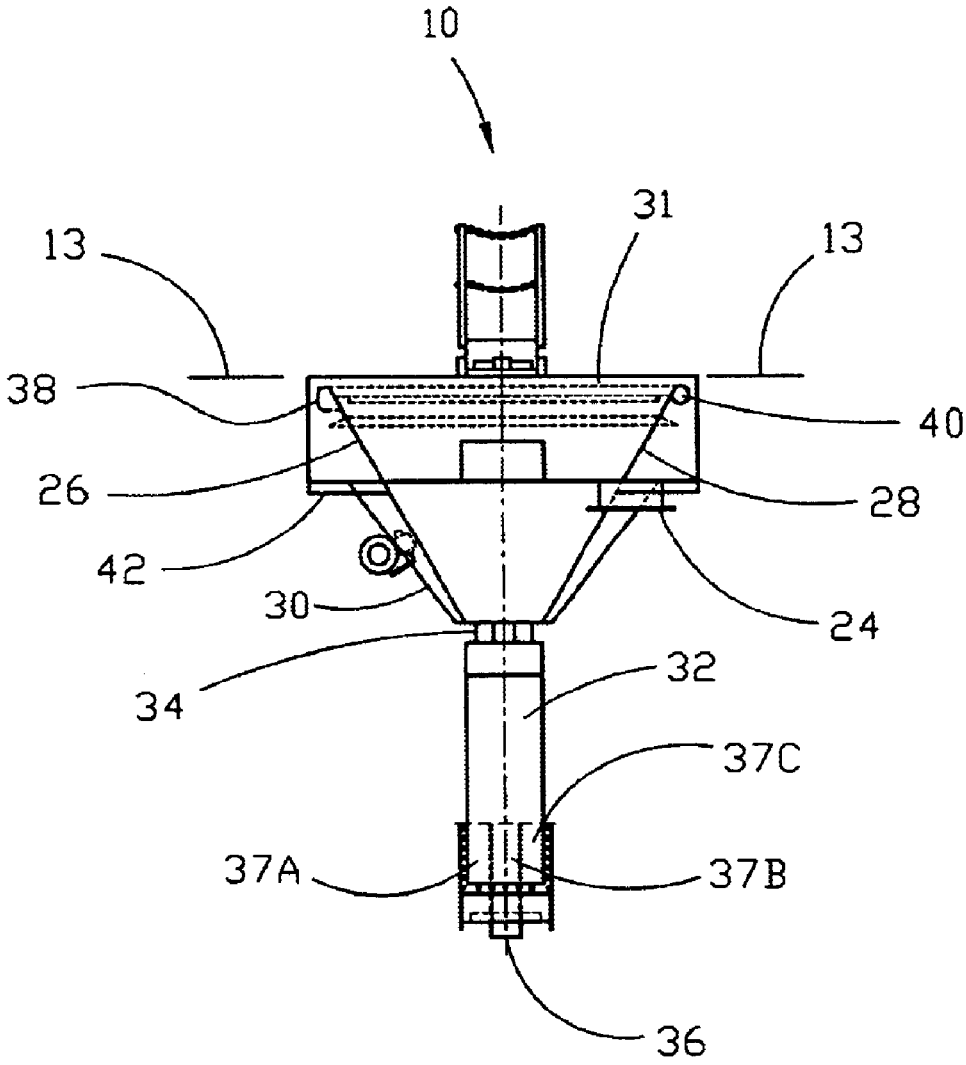
FIG. 4 is a right side view of the preferred embodiment of the sand tank assembly illustrated by FIGS. 1 through 3.

Still referring to FIG. 1, the preferred receptacle 12 includes side walls 26 and 28 (See FIG. 2). Side walls 26 and 28 and discharge end 22 are preferably sloped, i.e., arranged such that they are not normal to the ground surface on which the tank assembly is located (See also FIGS. 3–6). While FIGS. 3–6 show side walls 26 and 28 and discharge end 22 having planar sloped configurations, it is contemplated within the scope of the invention that the side walls and discharge end may have any suitable configuration for classifying and blending sand products such as a curved or some other non-linear configuration. Further, a plurality of vertical reinforcing plates 30 are preferably mounted to side walls 26 and 28 in order to provide additional structural support to the receptacle. The preferred vertical reinforcing plates 30 are mounted to the side walls in a generally normal disposition to the side walls. Preferably, vertical reinforcing plates 30 extend from the bottom of the side walls to the top of the side walls. It is contemplated within the scope of the invention, however, that the vertical reinforcing plates extend along only a portion of the side walls of the receptacle. Vertical reinforcing plates 30 also preferably have a tapered profile (See also FIGS. 3, 4 and 6). While FIGS. 3, 4 and 6 show vertical reinforcing plates 30 having a linear tapered profile, it is contemplated within the scope of the invention that the tapered profile of plates 30 may be non-linear. It is also contemplated that plates 30 may be wider near the bottom of the receptacle and narrower toward the top of the receptacle.

Still referring to FIG. 1, the preferred tank assembly 10 further includes a plurality of upper cross tubes 31 adapted to provide structural stability to the tank assembly (See also FIGS. 2–5 and 7). The preferred upper cross tubes 31 are mounted to and extend between the pair of side walls 26 and 28 of receptacle 12. Further, the preferred upper cross tubes 31 are disposed above upper level 13 of the receptacle. Because upper cross tubes 31 are disposed above the upper level of the receptacle, they do not produce turbulence or interfere with the natural flow and settling of the slurry in the receptacle.

Referring still to FIG. 1, the preferred tank assembly 10 also includes slurry collecting flume 32. The preferred slurry collecting flume 32 is located below receptacle 12 and extends between and is in communication with a plurality of slurry discharge pipes 34. The plurality of slurry discharge pipes 34 are in communication with receptacle 12, and preferably, each slurry discharge pipe includes elbow 35 which is adapted to improve the flow of slurry from the receptacle toward slurry collecting flume outlet 36. The preferred slurry collecting flume 32 is adapted to receive slurry from slurry discharge pipes 34 and convey the slurry to slurry collecting flume outlet 36. Slurry collecting flume outlet 36 is adapted to convey slurry from the tank assembly. As shown in FIGS. 3 and 4, the preferred slurry collecting flume 32 has a plurality of separate cells 37A, 37B and 37C. Separate cells 37A, 37B and 37C are adapted to convey slurry to slurry collecting flume outlet 36. More particularly, separate cells 37A, 37B and 37C are adapted to maintain the separation of different slurry classifications and convey the individual slurry products to a central location for discharge from the assembly. In the alternative, separate cells 37A, 37B and 37C may be used to blend different classifications of slurry discharged from the tank assembly.

Still referring to FIG. 1, the preferred tank assembly 10 further includes a pair of overflow collecting flumes 38 and 40 (See FIG. 2) for conveying excess water, clay, silt, slimes and the like to receptacle overflow outlet 24. The preferred overflow collecting flumes 38 and 40 extend from the feed end to the discharge end and are mounted along side walls 26 and 28, respectively. Further, the preferred overflow collecting flumes 38 and 40 are in communication with receptacle overflow outlet 24. Also in a preferred embodiment, the overflow collecting flumes are adjustable so that turbulence can be reduced, retention and removal of excess clay, silt, slimes and the like can be increased, and sand classification can be improved. More particularly, the preferred collecting flumes may be adjusted to control the level of the slurry and water in the receptacle and the depth of the overflow in the overflow collecting flumes. It is contemplated within the scope of the invention that more or less than two overflow collecting flumes may be provided to remove excess water, clay, silt, slimes and the like.

Referring still to FIG. 1, the preferred tank assembly 10 also includes a plurality of lateral support tubes 42 mounted to the exterior of side walls 26 and 28 (See also FIGS. 3, 4 and 6) of receptacle 12. Lateral support tubes 42 are adapted to provide structural support to the receptacle, and consequently, may be provided in any convenient shape. Preferably, lateral support tubes 42 comprise pieces of square tubing that are mounted to the exterior of the side walls of the receptacle in a generally parallel disposition to the upper cross tubes. Because lateral support tubes 42 do not extend into the interior space of the receptacle, they do not produce turbulence or interfere with the natural flow or settling of slurry in the receptacle.

Referring now to FIG. 2, a top view of preferred tank assembly 10 is illustrated. More particularly, FIG. 2 illustrates feed end reinforcing plate 43 mounted near the top of receptacle 12 (See also FIG. 5). Feed end reinforcing plate 43 is adapted to provide structural support to the receptacle. Also shown in FIG. 2, the preferred tank assembly 10 includes feed end 14, feed box 16, receptacle inlet 18, discharge end 22, receptacle overflow outlet 24, side walls 26 and 28, upper cross tubes 31, and overflow collecting flumes 38 and 40.

Figure 8:
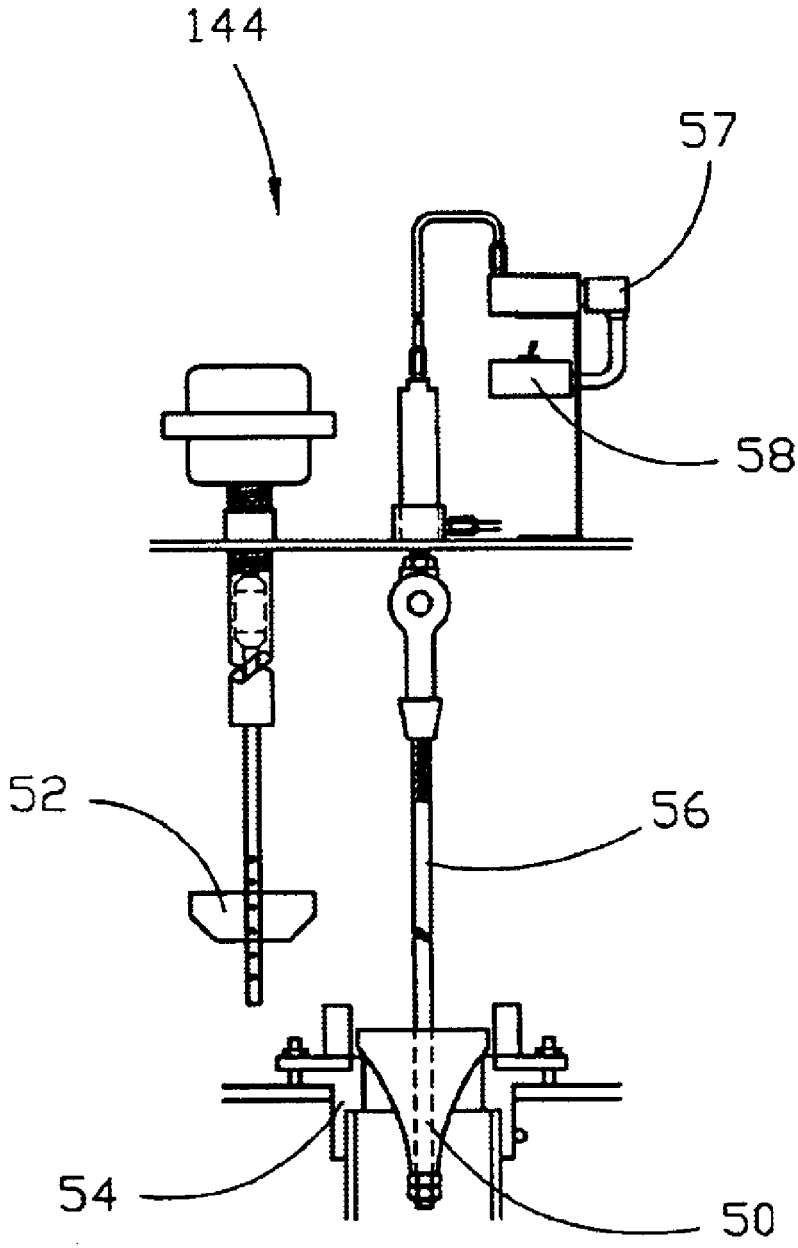
FIG. 8 is a side view of a preferred embodiment of the settling station of the sand tank assembly constructed in accordance with the present invention.

Still referring to FIG. 2, the preferred tank assembly 10 also includes a plurality of settling stations 44 mounted in receptacle 12 (See also FIG. 8). The preferred settling stations 44 are adapted to control the amount of slurry that is conveyed from receptacle 12 to slurry discharge pipes 34. More particularly, slurry settles near the bottom of each settling station 44. When a predetermined amount of slurry collects in the area of a settling station, the settling station transmits a signal to a tank controller (not shown). The tank controller then opens a discharge valve such as dart-shaped valve 50 (See FIG. 8) located near the bottom of receptacle 12 and slurry is discharged into slurry discharge pipe 34 (See FIG. 1). The slurry discharge pipe conveys the slurry to slurry collecting flume 32 which discharges the slurry from the tank assembly through slurry collecting flume outlet 36 (See FIG. 1).

Referring now to FIG. 3, a left side view of the preferred tank assembly shown in FIGS. 1 and 2 is illustrated. More particularly, as shown in FIG. 3, the preferred tank assembly 10 includes feed box 16, receptacle inlet 18, side walls 26 and 28, vertical reinforcing plates 30, upper cross tubes 31, slurry collecting flume 32, slurry discharge pipes 34, slurry collecting flume outlet 36, overflow collecting flumes 38 and 40, and lateral support tubes 42. As shown in FIG. 3, the preferred slurry collecting flume 32 has three separate cells 37A, 37B and 37C for conveying slurry to slurry collecting flume outlet 36, maintaining the separation of different slurry classifications, and/or blending different classifications of slurry prior to or upon their discharge from the tank assembly.

Referring now to FIG. 4, a right side view of the preferred tank assembly shown in FIGS. 1 through 3 is illustrated. More particularly, as shown in FIG. 4, the preferred tank assembly 10 includes receptacle overflow outlet 24, side walls 26 and 28, vertical reinforcing plates 30, upper cross tubes 31, slurry collecting flume 32, slurry discharge pipes 34, slurry collecting flume outlet 36 having separate cells 37A, 37B and 37C, overflow collecting flumes 38 and 40, and lateral support tubes 42.

Figure 5:
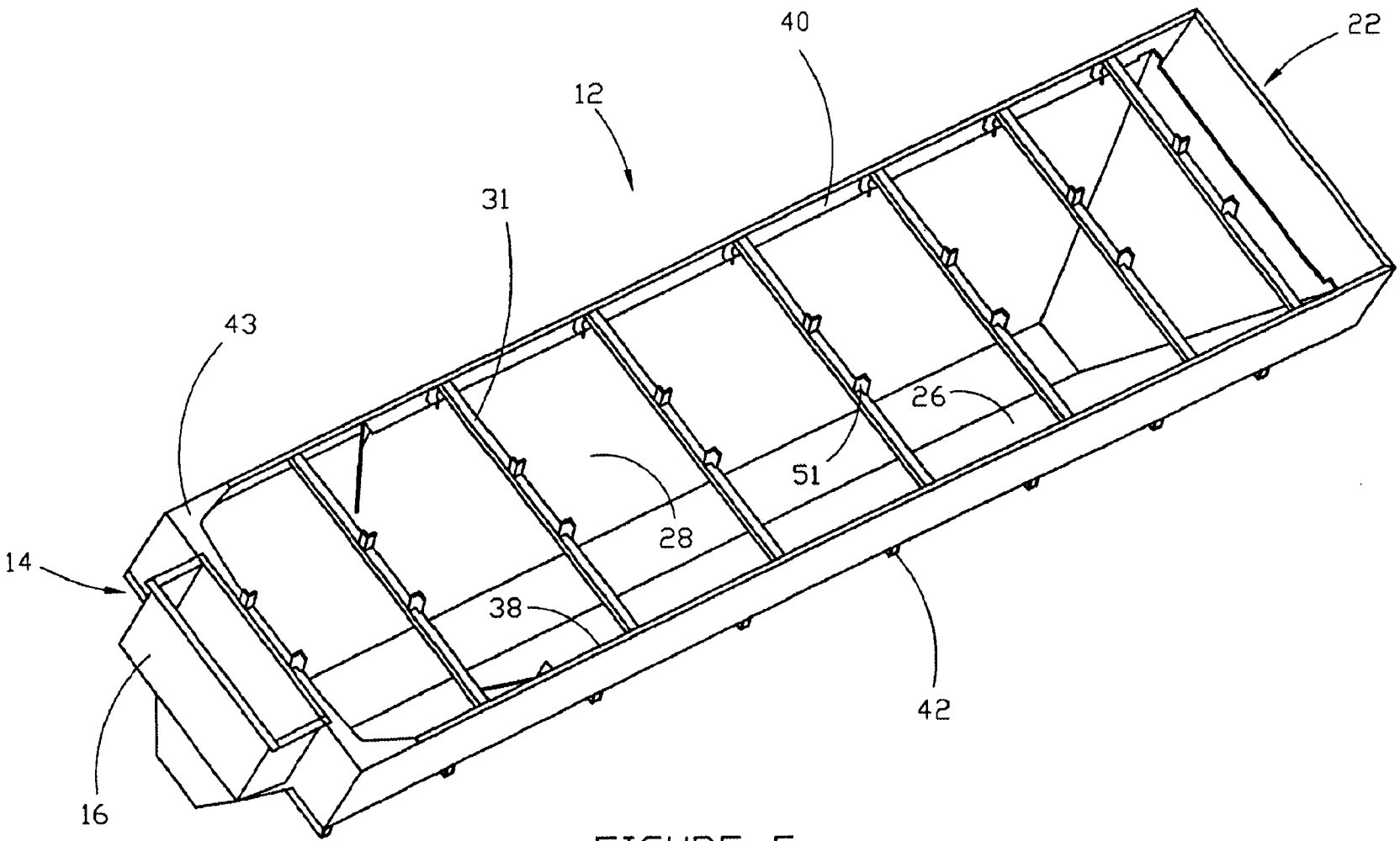
FIG. 5 is a top perspective view of the preferred embodiment of the receptacle, feed box and upper cross tubes of the sand tank assembly illustrated by FIGS. 1 through 4.
Figure 6:
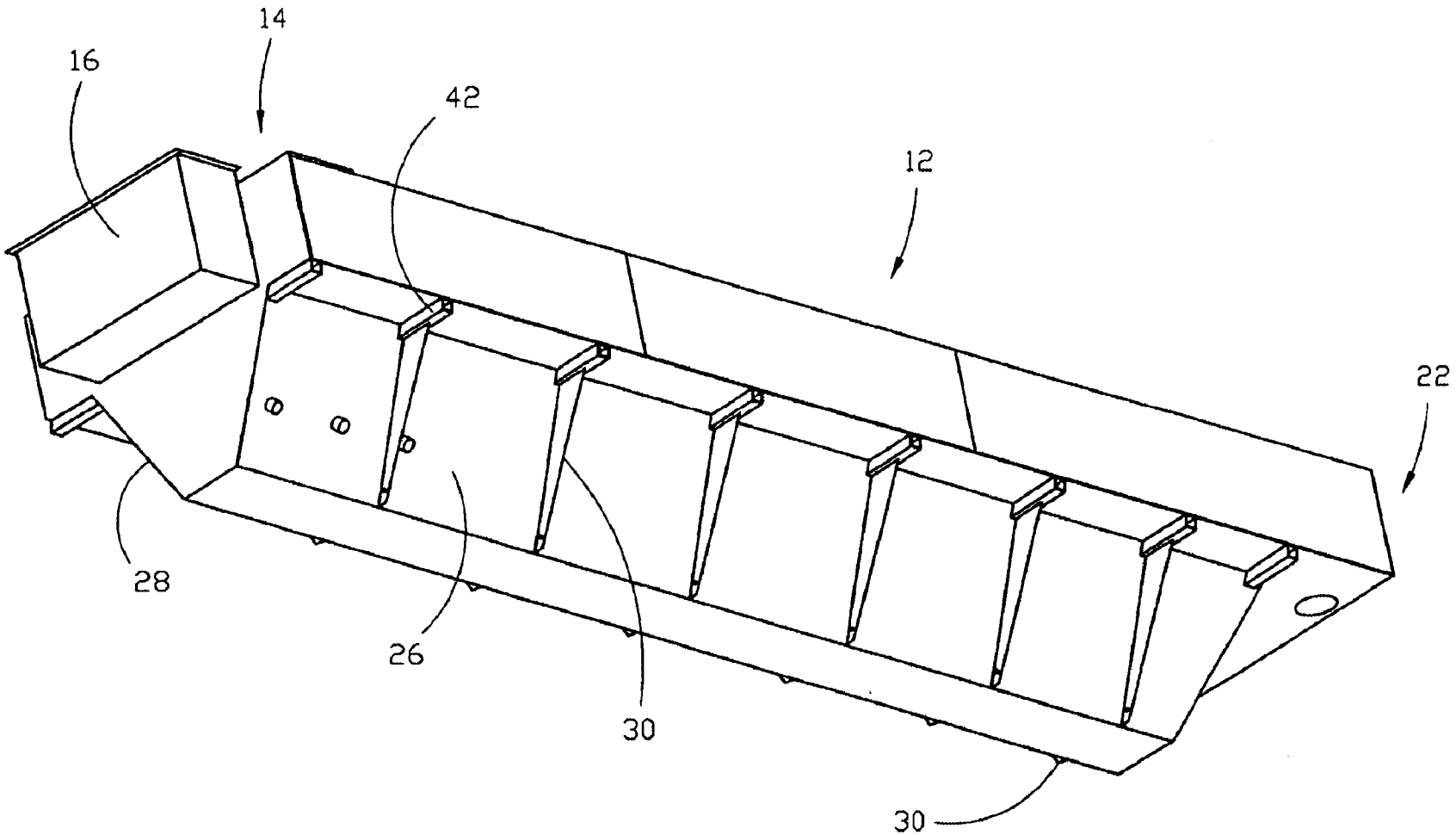
FIG. 6 is a bottom perspective view of the preferred receptacle, feed box, plurality of lateral support tubes, plurality of vertical reinforcing plates, and receptacle overflow outlet of the sand tank assembly illustrated by FIGS. 1 through 5.

Referring now to FIG. 5, a top perspective view of the preferred receptacle shown in FIGS. 1 through 4 is illustrated. More particularly, as shown in FIG. 5, the preferred receptacle 12 includes feed end 14, feed box 16, discharge end 22, side walls 26 and 28, upper cross tubes 31, overflow collecting flumes 38 and 40, lateral support tubes 42 and feed end reinforcing plate 43. As shown in FIG. 5, in a preferred embodiment, upper cross tubes 31 include angle brackets 51 mounted thereon. Angle brackets 51 are adapted to support settling stations 44 which are discussed in more detail below.

Referring now to FIG. 6, a bottom perspective view of the preferred receptacle shown in FIGS. 1 through 5 is illustrated. More particularly, as shown in FIG. 6, the preferred receptacle 12 includes feed end 14, feed box 16, discharge end 22, side walls 26 and 28, vertical reinforcing plates 30 and lateral support tubes 42.

Figure 7:
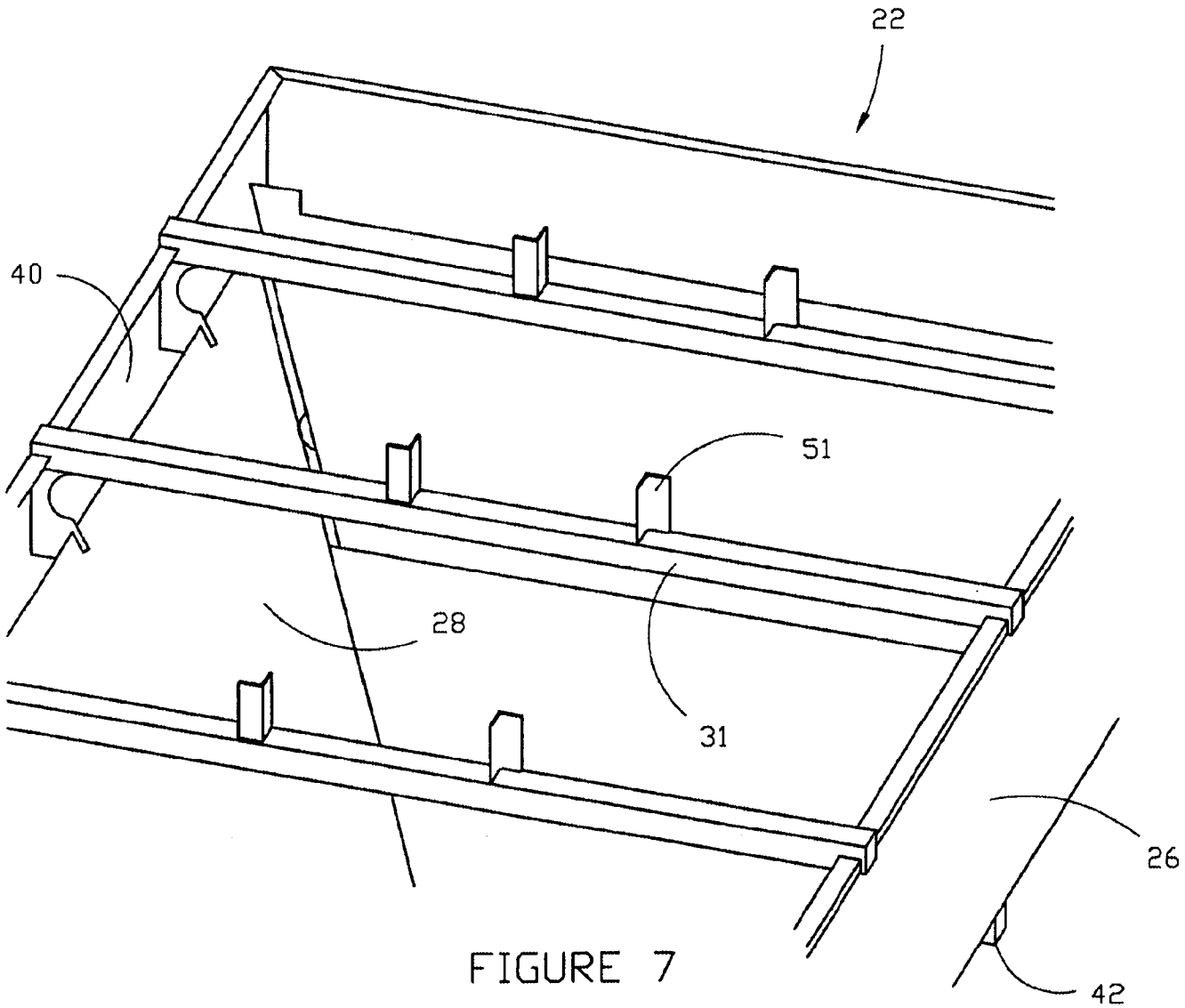
FIG. 7 is an enlarged top perspective view of the preferred embodiment of the upper cross tubes of the sand tank assembly illustrated by FIGS. 1 through 6.

Referring now to FIG. 7, an enlarged top perspective view of the preferred receptacle shown in FIGS. 1 through 6 is illustrated. More particularly, as shown in FIG. 7, the preferred receptacle 12 includes discharge end 22, side walls 26 and 28, upper cross tubes 31 having angle brackets 51, overflow collecting flume 40, and lateral support tubes 42.

Referring now to FIG. 8, a side view of a preferred embodiment of the settling station in accordance with the present invention is illustrated. More particularly, FIG. 8 depicts preferred settling station 144 having a single discharge valve such as a dart-shaped valve 50. Each preferred settling station 144 is adapted to discharge or "batch" sand into slurry collecting flume 32 located below the tank. As shown in FIG. 8, each preferred settling station 144 includes adjustable height sensing paddle 52 which is adapted to control the amount of slurry that accumulates at the settling station. More particularly, when a predetermined amount of sand accumulates at a settling station, the preferred paddle 52 stops rotating. When the paddle stops rotating, a signal is sent to a tank controller (not shown) which causes dart-shaped valve 50 to open. When dart-shaped valve 50 opens, slurry is discharged from the receptacle into slurry discharge pipe 34 and slurry collecting flume 32. As sand is discharged from the receptacle to the slurry collecting flume, the preferred paddle 52 is freed to rotate again, and a signal is sent to the tank controller which causes dart-shaped valve 50 to close.

Still referring to FIG. 8, each preferred settling station 144 includes one or more discharge valve such as dart-shaped valve 50. The preferred dart-shaped valve 50 is adapted to open to permit slurry to be conveyed from the receptacle and close to permit slurry to be retained in the receptacle. The preferred dart-shaped valves 50 are self-aligning and adapted to be received by seats 54 to provide a leak-resistant seal. It is contemplated within the scope of the invention, however, that the discharge valve may be any suitable valve adapted to open to discharge a quantity of slurry from the receptacle and close to produce a non-leaking seal which prevents slurry from exiting the receptacle. In addition, the preferred settling station 144 includes adjustable valve rods 56 to provide positive seating pressure between each dart-shaped valve 50 and seat 54. As shown in FIG. 1, each preferred settling station 144 also includes slurry discharge pipe 34. The preferred slurry discharge pipe 34 includes elbow 35 (See FIG. 1) adapted to improve the flow of slurry from receptacle 12 to slurry collecting flume 32. Preferably, dart-shaped valves 50, seats 54 and slurry discharge pipe elbows 35 are composed of urethane or the like in order to increase durability and functionality.

Referring still to FIG. 8, each preferred settling station 144 also includes solenoid valve 57 adapted to control the opening and closing of dart-shaped valve 50. Each preferred settling station 144 also includes manual override switch 58. The preferred switch 58 is a toggle switch box with a three-position switch operatively connected to each discharge valve such as dart-shaped valve 50. The preferred switch is adapted to permit manual override of the discharge valves from a remote location such as the top of the tank assembly or a remote control panel.

Figure 9:
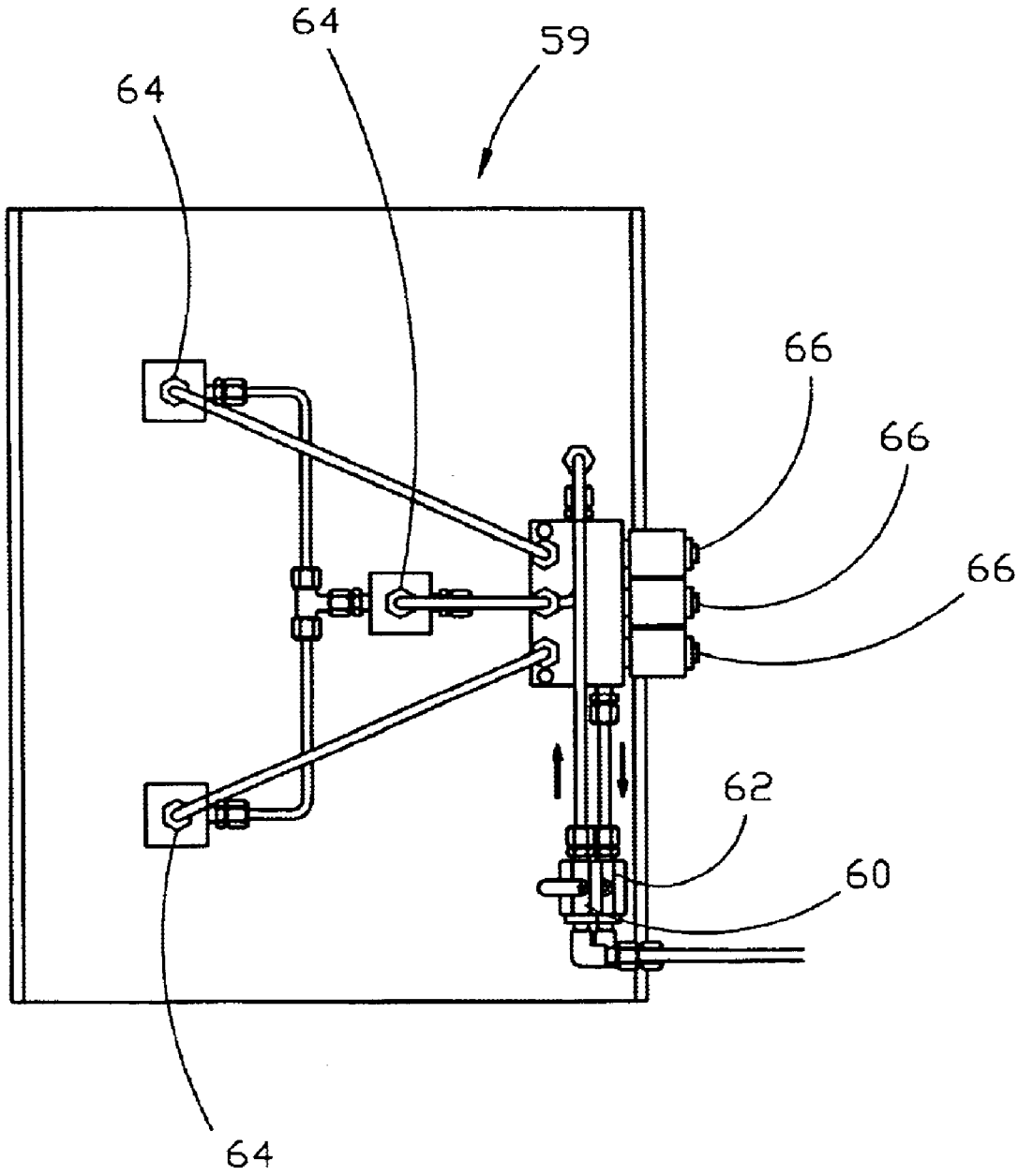
FIG. 9 is a top view of a preferred embodiment of the hydraulic system of a preferred settling station of a sand tank assembly constructed in accordance with the present invention.

Referring now to FIG. 9, a top view of a preferred embodiment of the hydraulic system of a preferred settling station is illustrated. More particularly, FIG. 9 illustrates preferred hydraulic assembly 59 adapted for use with a settling station having three discharge valves. As shown in FIG. 9, each preferred hydraulic assembly 59 includes ball valve 60 and check valve 62 which are in fluid communication with hydraulic actuators 64. The preferred ball valve 60 is adapted to permit the flow of fluid in one direction (as indicated by the arrow) and prevent the flow of fluid in the opposite direction. The preferred check valve 62 is adapted to permit the flow of fluid in only one direction (as indicated by the arrow). Each of the hydraulic actuators is operably connected to a discharge valve (not shown). Solenoid valves 66 are also provided to control the opening and closing of the discharge valves. The separate ball valve 60 and check valve 62 for each settling station provides the settling stations with flexibility in troubleshooting and permits a single settling station to be serviced without impacting the operation of the other settling stations.

In operation, several advantages of the invention are achieved. For example, slurry such as a mixture of water and sand is introduced into the receptacle of the tank assembly by feeding the slurry into the feed box having a curved liner. The curved liner in the feed box improves the flow of slurry into the receptacle towards the discharge end and results in a more efficient and consistent settling and classification of sand in the receptacle. The flow of slurry toward the discharge end and the settling of sand to the bottom of the receptacle is further improved by the absence of lateral support structures disposed within the slurry in the receptacle. The placement of these lateral support structures above the upper level of the receptacle eliminates turbulence in and interference with the natural flow of slurry and the settling and classification of sand in the receptacle.

In addition, the overflow collecting flumes of the preferred tank assembly extend along the entire length of the receptacle. As a result, the preferred tank assembly more effectively and efficiently removes excess water, clay, silt, slimes and the like from the receptacle. Consequently, the classification and blending of sand products produced by the preferred tank assembly is improved. In addition, the overflow collecting flumes contribute to the structural stability of the tank assembly. The overflow collecting flumes are also adjustable so that turbulence in the receptacle may be minimized, removal of excess water, clay, silt, slimes and the like may be achieved more efficiently, and classification and blending of sand products may be achieved more efficiently. Further, the structural support components of the preferred tank assembly result in a stronger, less complicated and less expensive apparatus.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A tank assembly for classifying and blending sand products, said tank assembly comprising:

A. a receptacle adapted to retain slurry at or below an upper level, said receptacle comprising:
  (i) a feed end having a receptacle inlet;
  (ii) a discharge end having a receptacle overflow outlet, said discharge end being generally opposed to the feed end;
  (iii) a pair of side walls extending between the feed end and the discharge end;

B. a plurality of upper cross tubes mounted to and extending between the pair of side walls of the receptacle, each of said plurality of upper cross tubes being disposed above the upper level of the receptacle;

C. a plurality of settling stations mounted in the receptacle, each of said settling stations comprising:
  (i) an adjustable height sensing paddle adapted to control the amount of slurry that accumulates at the station;
  (ii) a discharge valve;
  (iii) a slurry discharge pipe;

D. a slurry collecting flume extending to and in communication with the slurry discharge pipes, said slurry collecting flume having a slurry collecting flume outlet.

2. The tank assembly of claim 1 wherein the feed end comprises a feed box having a curved liner.

3. The tank assembly of claim 1 wherein the feed end of the receptacle includes a feed end reinforcing plate mounted near the top of the receptacle.

4. The tank assembly of claim 1 wherein an overflow collecting flume extends from the feed end to the discharge end, said overflow collecting flume being in communication with the receptacle overflow outlet.

5. The tank assembly of claim 1 wherein the assembly comprises a plurality of overflow collecting flumes, each of said overflow collecting flumes extending from the feed end to the discharge end and being in communication with the receptacle overflow outlet.

6. The tank assembly of claim 1 wherein a plurality of lateral support tubes are mounted to the exterior of the pair of side walls of the receptacle.

7. The tank assembly of claim 1 wherein the discharge end and the pair of side walls of the receptacle are sloped.

8. The tank assembly of claim 1 wherein a plurality of vertical reinforcing plates are mounted to the pair of side walls of the receptacle.

9. The tank assembly of claim 8 wherein the plurality of vertical reinforcing plates have a tapered profile.

10. The tank assembly of claim 1 wherein the discharge valve of each settling station is operated by a hydraulic actuator.

11. The tank assembly of claim 1 wherein each settling station comprises a ball valve, a check valve and a switch.

12. The tank assembly of claim 1 wherein each settling station comprises a dart-shaped valve and a seat adapted to receive said dart-shaped valve.

13. The tank assembly of claim 1 wherein each slurry discharge pipe comprises an elbow.

14. The tank assembly of claim 1 wherein the slurry collecting flume comprises a plurality of separate cells.

* * * * *